US006584946B2

(12) United States Patent
Cardno et al.

(10) Patent No.: US 6,584,946 B2
(45) Date of Patent: Jul. 1, 2003

(54) INTAKE MANIFOLD

(75) Inventors: Robert Cardno, Kariya (JP); Yasutoshi Kameda, Toyota (JP)

(73) Assignee: Denso Corporation (JP)

( * ) Notice: Subject to any disclaimer, the term of this patent is extended or adjusted under 35 U.S.C. 154(b) by 0 days.

(21) Appl. No.: 09/898,061

(22) Filed: Jul. 5, 2001

(65) Prior Publication Data

US 2002/0005183 A1 Jan. 17, 2002

(30) Foreign Application Priority Data

Jul. 11, 2000 (JP) ..... 2000-209785
Mar. 19, 2001 (JP) ..... 2001-78103

(51) Int. Cl.[7] ..... F02M 35/10
(52) U.S. Cl. ..... 123/184.34; 123/184.61
(58) Field of Search ..... 123/184.34, 184.61

(56) References Cited

U.S. PATENT DOCUMENTS 5,636,605 A * 6/1997 Nomizo et al. ..... 123/184.61

FOREIGN PATENT DOCUMENTS

JP 56-148661 11/1981
JP 63-159 1/1988
JP 8-193546 7/1996

OTHER PUBLICATIONS

Morota et al.: "Development of Plastic Intake Manifold" Toyota Technical Review vol. 46 No. 2, pp. 2–7, Nov. 1996.

* cited by examiner

*Primary Examiner*—Tony M. Argenbright
*Assistant Examiner*—Katrina B. Harris
(74) *Attorney, Agent, or Firm*—Nixon & Vanderhye PC

(57) ABSTRACT

In an intake manifold, a resin intake air introduction portion has a semicircular lower intake pipe, a volume chamber and joints provided in the volume chamber at opposite sides and along an axis of the lower intake pipe. An aluminum intake air distribution portion has a semicircular upper intake pipe, which is combined with the lower intake conduit to constitute an intake conduit, and distribution pipes extending alternately in opposite directions so as to cross an axis of the upper intake pipe. The aluminum intake air distribution portion overlaps the resin intake air introduction portion on a side opposite to the engine. Each end of the distribution pipes is connected to the joints and each another end thereof is fixed to the engine. The lower intake pipe is provided in an axial center thereof with a communication bore through which intake air is supplied from the intake conduit via the volume chamber, the joints and the distribution pipes to the engine.

14 Claims, 4 Drawing Sheets

INTAKE MANIFOLD

CROSS REFERENCE TO RELATED APPLICATION

This application is based upon and claims the benefit of priority of Japanese Patent Applications No. 2000-209785 filed on Jul. 11, 2000 and No. 2001-78103 filed on Mar. 19, 2001, the contents of which are incorporated herein by reference.

BACKGROUND OF THE INVENTION

1. Field of the Invention

The present invention relates to an intake manifold having an intake passage made of resin and metal.

2. Description of Related Art

It is known to make an entire body of an intake manifold from metal to improve heat resistance and strength for joining with an engine. However, an intake manifold formed of metal is heavy in weight and has a higher manufacturing cost.

It is also known to provide an intake manifold applied to a V-type engine with metal distribution pipes arranged on a bank of the engine and a resin intake air introduction pipe arranged on a side opposite to the engine with respect to the distribution pipes.

According to the conventional intake manifold having the resin intake air introduction pipe, noises due to the following are emitted through the resin pipe;

(a) pressure pulsation of intake air on opening and closing intake valves, (b) throttle noises generated by a valve member of a throttle device that rotates rapidly to change from a closing state to an opening state on quick engine starting, and (c) airflow noises of intake air flowing in the intake manifold.

When the pressure pulsation, the throttle noises and the airflow noises as mentioned above are transmitted to the resin intake air introduction pipe of the intake manifold, which is arranged on the side opposite to the engine with respect to the metal distribution pipes and whose resilience is smaller than the metal pipe, the noises are emitted to the outside through the resin pipe.

SUMMARY OF THE INVENTION

An object of the invention is to provide an intake manifold in which emitting noises are limited without increasing the weight and the manufacturing cost.

To achieve the above objects, the intake manifold is composed of a resin member and a metal member. The metal member is combined with and holds the resin member so as to overlap the resin member on a side opposite to the engine so that the resin member and the metal member constitute an intake passage through which intake air is supplied from a throttle device to each cylinder of the engine. The metal member is provided with fittings for mounting the intake manifold on the engine.

With the intake manifold mentioned above, even if the pressure pulsation, the throttle noises and the airflow noises are transmitted to the resign portion, the metal portion shields the noise emitted from the resin portion so that the noises are prevented from being given out to the outside since the metal portion overlaps the resin portion on a side opposite to the engine. The intake manifold mentioned above has a noise shield effect similar to that of the conventional all metal intake manifold and, further, is lighter in weight and manufactured at less cost, compared with the conventional all metal intake manifold.

In a case of classifying the intake passage into an intake air introduction passage connectable to the throttle device and a plurality of intake air distribution passages, one end of each of which is connectable via the fittings to each of the cylinders of the engine and the other end of each of which communicates with the intake air introduction passage, it is preferable that the resin member mainly constitutes the intake air introduction passage and the metal member mainly constitutes the intake air distribution passages.

Further, it is preferable in view of lighter weight and lower cost that the metal member is made of aluminum.

BRIEF DESCRIPTION OF THE DRAWING

Other features and advantages of the present invention will be appreciated, as well as methods of operation and the function of the related parts, from a study of the following detailed description, the appended claims, and the drawings, all of which form a part of this application. In the drawings:

DETAILED DESCRIPTION OF THE PREFERRED EMBODIMENTS

First Embodiment

Figure 1:
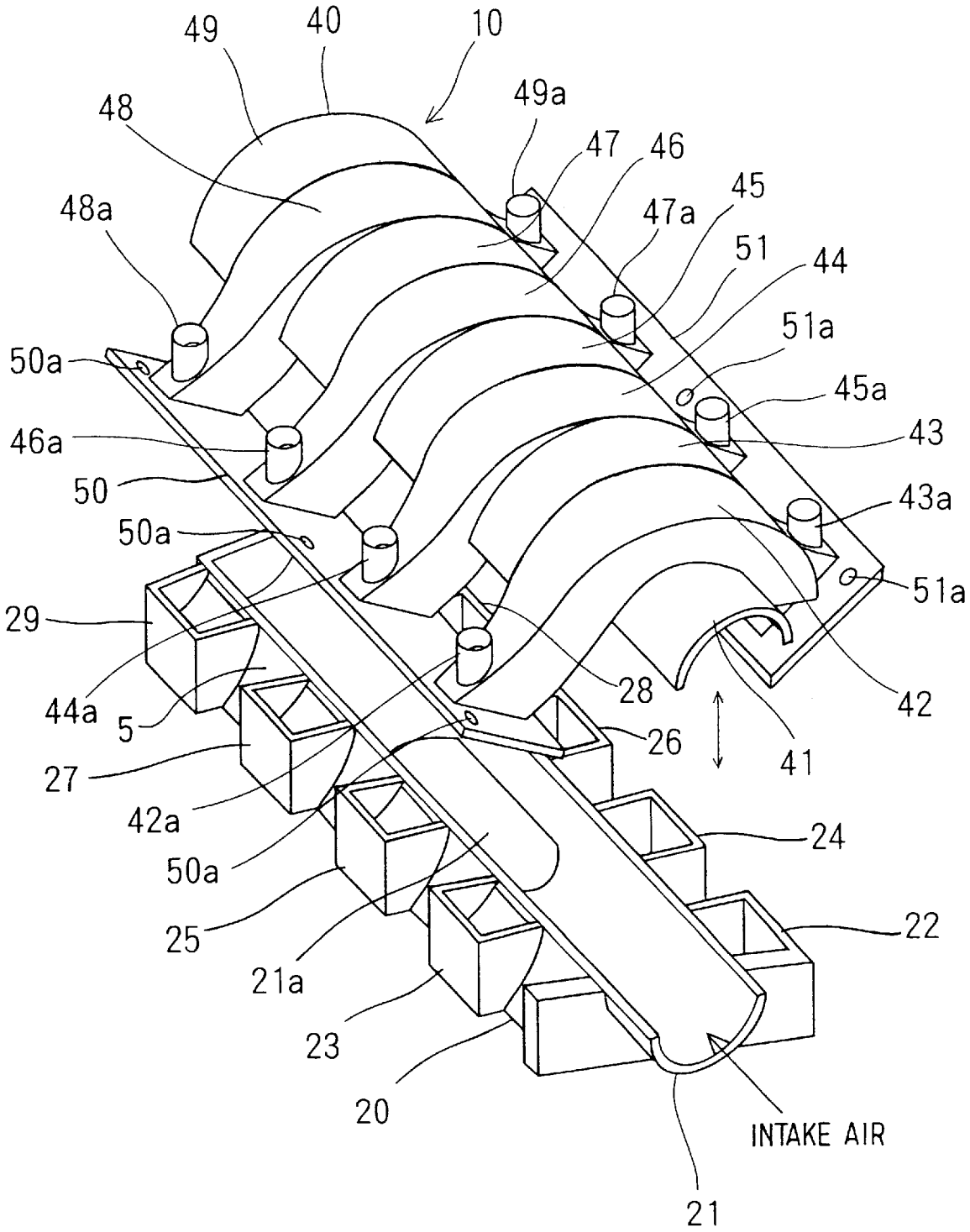
FIG. 1 is an exploded perspective view of an intake manifold according to a first embodiment of the present invention.

An intake manifold according to a first embodiment is described with reference to FIGS. 1, 2 and 3. An intake manifold 10, through which intake air is supplied to a V-type 8 cylinder engine, is arranged on an intake air downstream side with respect to a throttle device (not shown). As shown in FIG. 1, the intake manifold 10 is composed of a resin intake air introduction portion 20 and an aluminum intake air distribution portion 40, which are combined with each other.

As shown in FIG. 1, the resin intake air introduction portion 20 has a semicircular lower intake pipe 21, a volume chamber 5 provided under the lower intake pipe 21 and 8 pieces of joints 22, 23, 24, 25, 26, 27, 28 and 29, a half of which are arranged at an outer surface of the volume chamber 5 at a side of the lower intake pipe 21 and the other half of which are arranged at the outer surface of the volume chamber 5 at the other side of the lower intake pipe 21. The joints 22, 23, 24, 25, 26, 27, 28 and 29 are located at given axial intervals in the volume chamber 5 and extend perpendicularly to an axis of the lower intake pipe 21, respectively. The lower intake pipe 21 is combined with an upper intake pipe 41 of the aluminum intake air distribution portion 40, which is described later in detail, so as to constitute a cylindrical intake conduit 100.

The lower intake pipe 21 is provided roughly in an axial center thereof with a communication port 21*a*. The communication port 21*a* communicates with the volume chamber 5, which is provided under the lower intake pipe 21 along an axis thereof, communicating with insides of the respective joints 22, 23, 24, 25, 26, 27, 28 and 29. The intake air flowing in a direction shown by an arrow in FIG. 1 is distributed via the communication port 21*a* and the volume chamber 5 to the respective joints 22, 23, 24, 25, 26, 27, 28 and 29.

The intake air distribution portion 40 has the upper intake pipe 41 whose shape is semicircular. Distribution pipes 42, 43, 44, 45, 46, 47, 48 and 49 are disposed on an outer circumferential wall so as to extend alternately in opposite directions so as to cross an axis of the upper intake pipe 41. Respective ends of the distribution pipes 42, 44, 46 and 48 on a side of a first group of engine intake ports are connected to a flange board 50 (fittings) to be mounted on and fixed to the engine 60. Respective ends of the distribution pipes 43, 45, 47 and 49 on a side of a second group of engine intake ports are connected to a flange board 51 (fittings) to be mounted on and fixed to the engine 60. The flange boards 50 and 51 are provided with installation holes 50*a* and 51*a*, respectively. The flange boards 50 and 51 are fastened to the engine 60 by bolts (not shown) inserted into the respective installation holes 50*a* and 51*a* so that the distribution pipes 42, 43, 44, 45, 46, 47, 48 and 49 communicate respectively with the first and second groups of engine intake ports between which the intake conduit 100 is positioned. Each of the distribution pipes 42, 43, 44, 45, 46, 47, 48 and 49 is provided on each side of the engine intake ports with an injector mounting hole 42*a*, 43*a*, 44*a*, 45*a*, 46*a*, 47*a*, 48*a* or 49*a*.

Figure 2:
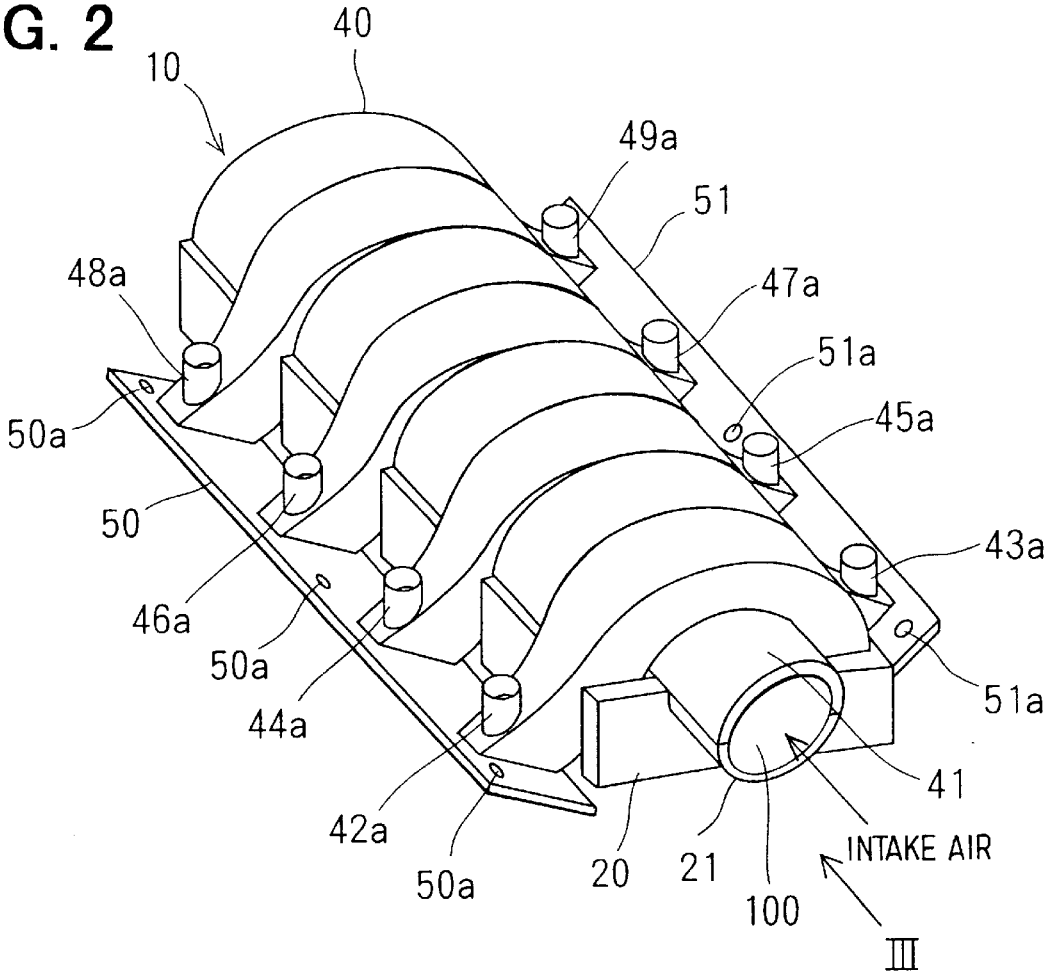
FIG. 2 is a perspective view of the intake manifold according to the first embodiment.

As shown in FIG. 2, to combine the intake air introduction portion 20 with the intake air distribution portion 40, the joints 22, 24, 26 and 28 are connected, for example, by bolts (not shown), to the other ends of the distribution pipes 42, 44, 46 and 48, respectively, and the joints 23, 25, 27 and 29 are connected, for example, by bolts (not shown), to the other ends of the distribution pipes 43, 45, 47 and 49, respectively. Accordingly, the intake air introduced to the intake conduit 100 is distributed via the volume chamber 5, the joints 22, 23, 24, 25, 26, 27, 28 and 29, and the distribution pipes 42, 43, 44, 45, 46, 47, 48 and 49 to the first and second groups of engine intake ports. The intake conduit 100, the volume chamber 5, the joints 22, 23, 24, 25, 26, 27, 28 and 29, and the distribution pipes 42, 43, 44, 45, 46, 47, 48 and 49 constitute an intake passage.

A noise shield effect of the intake manifold according to the first embodiment is described below.

Noises are generated by (a) pressure pulsation of intake air on opening and closing intake valves, (b) throttle noises generated by a valve member of a throttle device that rotates rapidly to change from a closing state to an opening state on quick engine starting and (c) airflow noises of intake air flowing in the intake manifold.

When the pressure pulsation, the throttle noises and the airflow noises as mentioned above are transmitted to the aluminum intake air distribution portion 40 and the resin intake air introduction portion 20, the aluminum intake air distribution portion 40, whose resilience is high and which absorbs the noises, does not emit the noises, but the resin intake air introduction portion 20, whose resilience is low and which does not absorb the noises, is likely to emit the noises.

Figure 3:
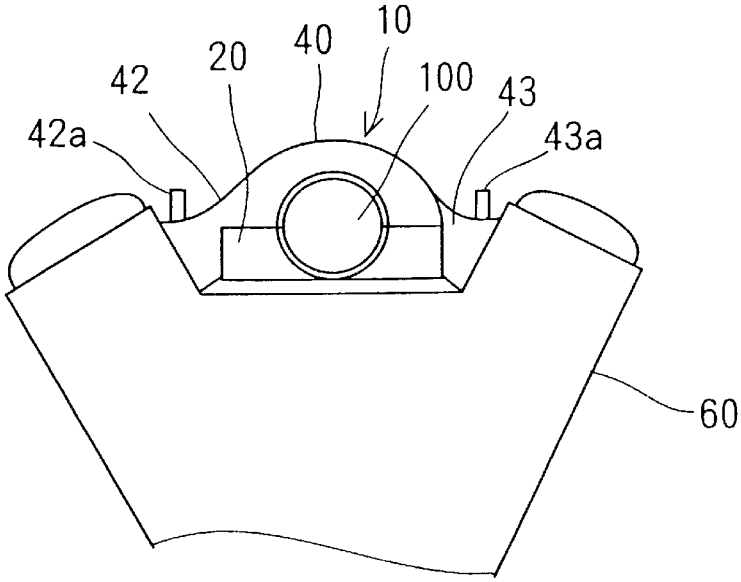
FIG. 3 is a schematic view of the intake manifold mounted on an engine as viewed from an arrow III in FIG. 2.

According to the first embodiment, as shown in FIGS. 1 to 3, the aluminum intake air distribution portion 40 overlaps a substantially entire part of the resin intake air introduction portion 20 on a side opposite to the engine 60. The aluminum intake air distribution portion 40 serves to shield the noise emitted from the resin intake air introduction portion 20 so that the noises are prevented from being given out to the outside.

Figure 4:
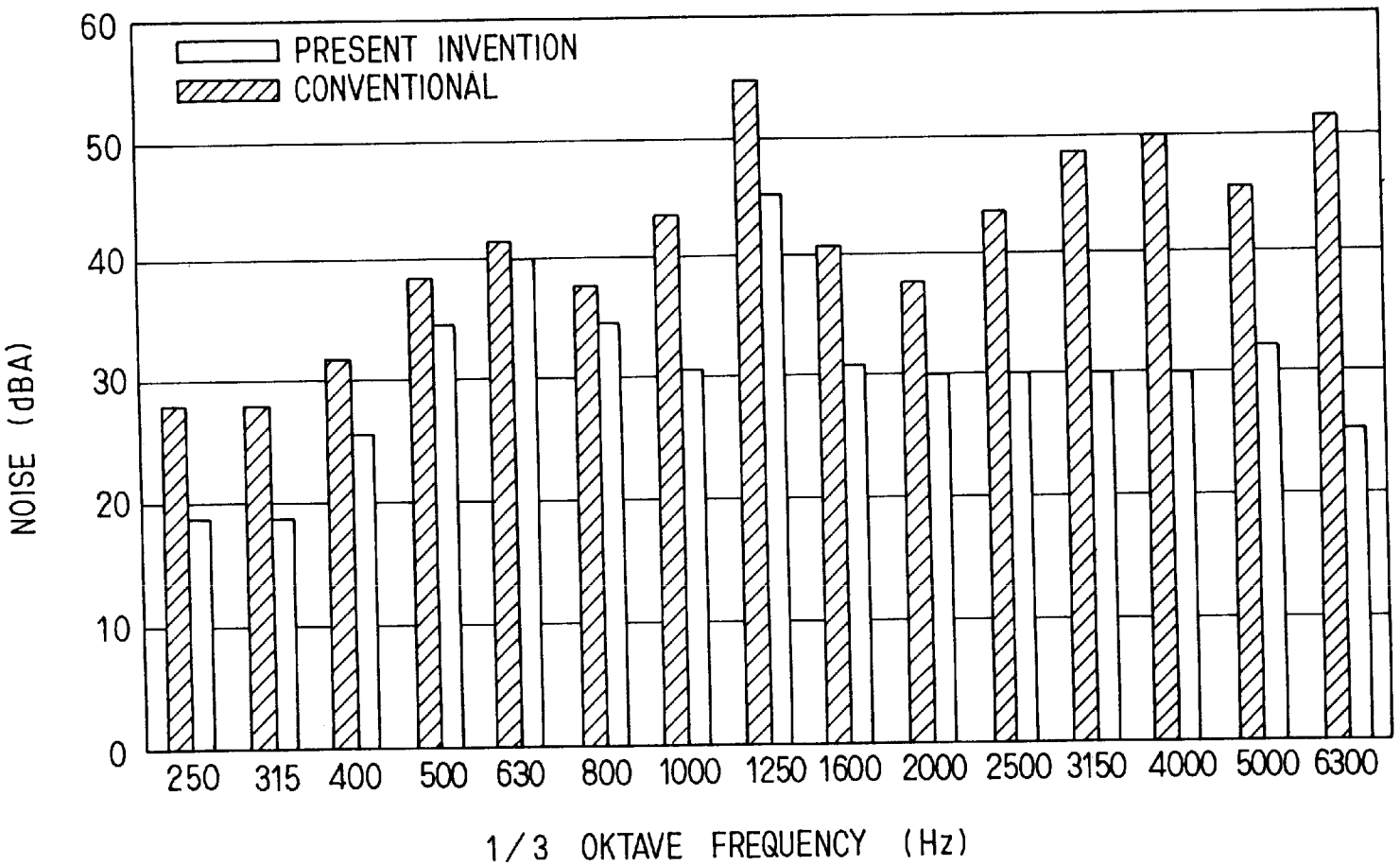
FIG. 4 is a graph showing a relation between noise frequency and loudness in comparison of the intake manifold according to the first embodiment with a conventional intake manifold.

FIG. 4 shows a test result of a relationship between noise frequency and noise loudness in comparison of the intake manifold according to the first embodiment with the conventional intake manifold having resin and metal passage. The test result proves that the noise loudness of the intake manifold 10 is lower in an entire range of the noise frequency than that of the conventional intake manifold. From this test result, it can be concluded that the intake manifold 10 of the present invention has an excellent noise shield effect.

According to the first embodiment, the communication bore 21*a* is provided roughly in the axial center of the lower intake pipe 21 so that the intake air is distributed from the intake conduit 100 through the communication bore 21*a*, the volume chamber 5 and the respective distribution pipes 42, 43, 44, 45, 46, 47, 48 and 49 to the respective engine intake ports. This construction serves to equalize lengths of respective air flow passages through which intake air is supplied from the throttle device to the engine intake ports so that noises due to length difference of the respective air flow passages are limited.

Instead of the communication bore 21*a*, the intake conduit 100, that is, the upper or lower intake pipe 41 or 21, may be provided with communication bores directly communicating with the respective joints 22, 23, 24, 25, 26, 27, 28 and 29 without passing through the volume chamber under the lower intake pipe 21. In this case, it is preferable that the intake conduit is also operative as the volume chamber.

Second Embodiment

Figure 5:
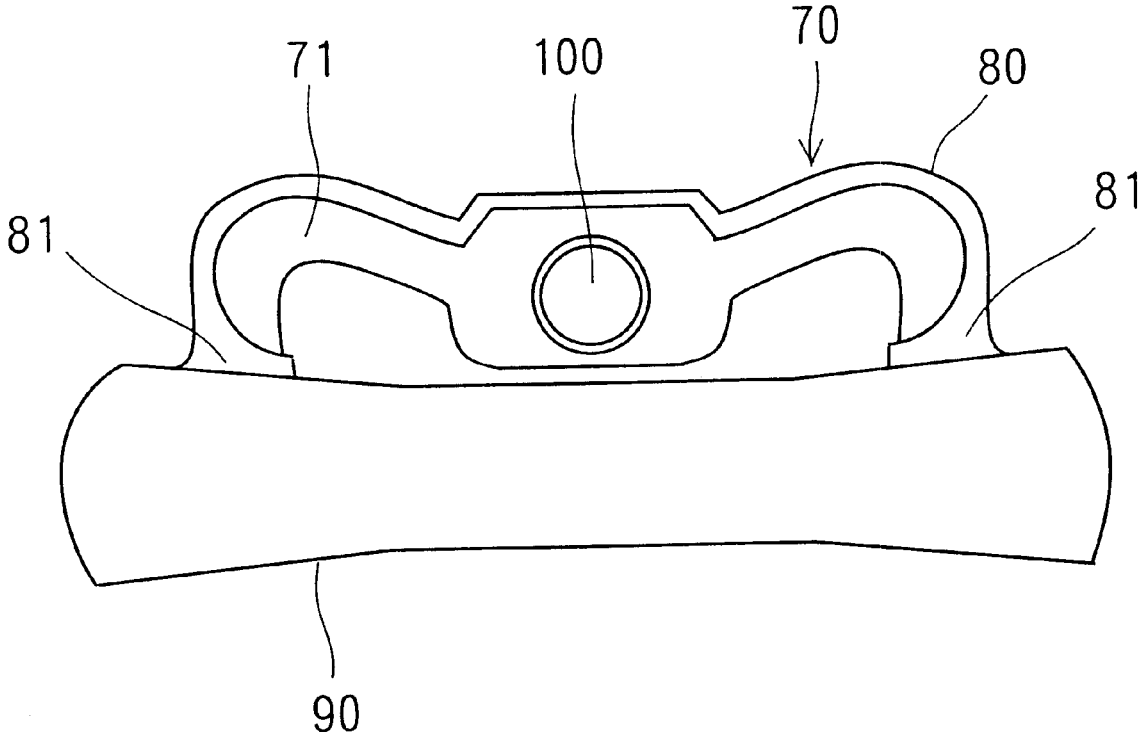
FIG. 5 is a schematic view of an intake manifold mounted on an engine according to a second embodiment as viewed from the same direction as in FIG. 3.

An intake manifold according to a second embodiment is described with reference to FIG. 5. An intake manifold 70 is for distributing intake air to each cylinder of a horizontally opposed engine 90. An aluminum intake air distribution portion 80 overlaps a resin intake air introduction portion 71 on a side opposite to the engine 90. The resin intake air introduction portion 71 is connected to the intake air distribution portion 80 and the intake air distribution portion 80 is fastened to the engine 90 via flange boards 81.

Even if the noises generated in an intake system are transmitted to the resin intake air introduction portion 71, the noises are shielded by the aluminum intake air distribution portion 80 covering the resin intake air introduction portion 71 on a side opposite to the engine so that the noises are prevented from being emitted to the outside.

In the embodiments mentioned above, the intake air distribution portion may be made of, instead of aluminum, any metal other than aluminum such as magnesium.

The intake manifold according to the embodiments mentioned above is applied not only to the V-type 8 cylinder engine or the horizontally opposed engine but also to any V-type engine having any number of engine cylinders or any other type engine.

What is claimed is:

1. An intake manifold to be mounted on an engine, the intake manifold having an intake passage through which intake air is supplied from a throttle device to cylinders of the engine, comprising:

a resin member; and a metal member combined with and holding the resin member so as to overlap substantially an entire surface of the resin member on a side opposite to the engine and cause a surface of the resin member on a side of the engine to directly face the engine so that the resin member and the metal member constitute the intake passage, the metal member being provided with fittings for mounting a combination of the metal and resin members on the engine.

2. An intake manifold according to claim 1, wherein the intake passage comprises an intake air introduction passage connectable to the throttle device and a plurality of intake air distribution passages whose each end is connectable via the fittings to each of the cylinders of the engine and whose each another end communicates with the intake air introduction passage, and the resin member constitutes a substantial part of the intake air introduction passage except an axially extending upper part thereof and the metal member constitutes a substantial part of the intake air distribution passages and the axially extending upper part of the intake air introduction passage.

3. An intake manifold according to claim 1, wherein the metal member is made of aluminum.

4. An intake manifold to be mounted on an engine, the intake manifold having an intake passage through which intake air is supplied from a throttle device to each cylinder of the engine, comprising:

a resin member; and a metal member combined with and holding the resin member so as to overlap the resin member on a side opposite to the engine so that the resin member and the metal member constitute the intake passage, the metal member being provided with fittings for mounting the intake manifold on the engine, wherein the intake air introduction passage comprises an intake conduit, a volume chamber located adjacent to the intake conduit and communicating with the intake conduit and a plurality of joints arranged at given space intervals along an axis of the volume chamber and communicating with the volume chamber, and each of the intake air distribution passages is connected to each of the joints.

5. An intake manifold according to claim 3, wherein the intake conduit is circular and comprises a semi-circular lower intake pipe and a semi-circular upper intake pipe combined with the lower intake pipe, and the intake air distribution passages are distribution pipes creeping over an outer circumference of the upper intake pipe, and, further, wherein the lower intake pipe, the volume chamber and the joints constitute the resin member and the upper intake pipe and the distribution pipes constitute the metal member.

6. An intake manifold according to claim 5, wherein the lower intake pipe is provided roughly in an axial center thereof with a communication bore through which the intake conduit communicates with the volume chamber, the volume chamber is located on a side of the engine with respect to the lower intake pipe, and the joints are located at opposite sides of an axis of the lower intake pipe.

7. An intake manifold to be mounted on an engine, the intake manifold having an intake passage through which intake air is supplied from a throttle device to each cylinder of the engine, comprising:

a resin member; and a metal member combined with and holding the resin member so as to overlap the resin member on a side opposite to the engine so that the resin member and the metal member constitute the intake passage, the metal member being provided with fittings for mounting the intake manifold on the engine, wherein the intake air introduction passage is located between the cylinders of the engine and the respective intake air distribution passages extend alternately in opposite directions so as to cross an axis of the intake air introduction passage to distribute intake air to the respective cylinders of the engine.

8. An intake manifold for distributing intake air to cylinders of an engine, comprising:

a resin intake air introduction portion for defining at least a portion of an intake passage of the intake manifold through which intake air is supplied from a throttle device for distribution to each cylinder of the engine; and a metal intake air distribution portion disposed to overlap substantially and entire surface of said resin intake air introduction portion on a side thereof opposite to the engine and cause a surface of the resin intake air introduction portion on a side of the engine to directly face the engine, said metal intake air distribution portion being fastened to the engine to mount the combination of the metal and resin portions on the engine, whereby the metal intake air distribution portion shields noises transmitted to the resin intake air introduction portion so as to reduce noise emission to an exterior of the intake manifold.

9. An intake manifold according to claim 8, the intake passage comprises an intake air introduction passage connectable to the throttle device and a plurality of intake air distribution passages one end of which is connectable to each of the cylinders of the engine and the other end of which communicates with the intake air introduction passage, and the resin member constitutes a substantial part of the intake air introduction passage except an axially extending upper part thereof and the metal member constitutes a substantial part of the intake air distribution passages and the axially extending upper cart of the intake air introduction passage.

10. An intake manifold according to claim 8, wherein the metal intake air introduction portion is formed from aluminum.

11. An intake manifold for distributing intake air to each cylinder of an engine, comprising:

a resin intake air introduction portion for defining at least a portion of an intake passage of the intake manifold through which intake air is supplied from a throttle device for distribution to each cylinder of the engine; and a metal intake air distribution portion disposed to overlap said resin intake air introduction portion on a side thereof opposite to the engine, said metal intake air distribution portion being fastened to the engine whereby the metal intake air distribution portion shields noises transmitted to the resin intake air introduction portion so as to reduce noise emission to an exterior of the intake manifold, wherein the resin intake air introduction portion defines a generally semi-circular lower intake pipe portion and said metal intake air introduction portion defines a generally semi-circular upper intake pipe portion which defines together with said lower intake pipe portion an intake pipe of said intake manifold.

12. An intake manifold for distributing intake air to each cylinder of an engine, comprising:

a resin intake air introduction portion for defining at least a portion of an intake passage of the intake manifold through which intake air is supplied from a throttle device for distribution to each cylinder of the engine: and a metal intake air distribution portion disposed to overlap said resin intake air introduction portion on a side thereof opposite to the engine, said metal intake air distribution portion being fastened to the engine whereby the metal intake air distribution portion shields noises transmitted to the resin intake air introduction portion so as to reduce noise emission to an exterior of the intake manifold, wherein the engine has a plurality of cylinders, the intake passage comprises an intake air introduction passage connectable to the throttle device and a plurality of intake air distribution passages one end of which is connectable to each of the cylinders of the engine and the other end of which communicates with the intake air introduction passage, and the resin member mainly constitutes the intake air introduction passage and the metal member mainly constitutes the intake air distribution passages, wherein the intake air introduction passage comprises an intake conduit, a volume chamber located adjacent to the intake conduit and communicating with the intake conduit and a plurality of joints arranged at given space intervals along an axis of the volume chamber and communicating with the volume chamber, and each of the intake air distribution passages is connected to each of the joints.

13. An intake manifold according to claim 12, wherein the resin intake air introduction portion defines a generally semi-circular lower intake conduit portion and said metal intake air introduction portion defines a generally semi-circular upper intake conduit portion which defines together with said lower intake pipe portion the intake conduit of said intake air introduction passage.

14. An intake manifold according to claim 13, wherein the lower intake conduit portion is provided in about an axial center thereof with a communication bore through which the intake conduit communicates with the volume chamber.

* * * * *